US011295586B2

(12) United States Patent
Jonsson et al.

(10) Patent No.: US 11,295,586 B2
(45) Date of Patent: Apr. 5, 2022

(54) DETERMINING WHEN A BREAK-IN ATTEMPT IS IN PROCESS

(71) Applicant: ASSA ABLOY AB, Stockholm (SE)

(72) Inventors: Tomas Jonsson, Rönninge (SE); Mats Cederblad, Hässelby (SE); Johan Von Matern, Täby (SE); Fredrik Isaksson, Farsta (SE)

(73) Assignee: ASSA ABLOY AB, Stockholm (SE)

( * ) Notice: Subject to any disclaimer, the term of this patent is extended or adjusted under 35 U.S.C. 154(b) by 0 days.

(21) Appl. No.: 16/961,896

(22) PCT Filed: Dec. 18, 2018

(86) PCT No.: PCT/EP2018/085632
§ 371 (c)(1),
(2) Date: Jul. 13, 2020

(87) PCT Pub. No.: WO2019/141471
PCT Pub. Date: Jul. 25, 2019

(65) Prior Publication Data

US 2020/0388123 A1 Dec. 10, 2020

(30) Foreign Application Priority Data

Jan. 22, 2018 (EP) ..... 18152802

(51) Int. Cl.
*G08B 13/16* (2006.01)
*G08B 13/06* (2006.01)
*G08B 29/18* (2006.01)

(52) U.S. Cl.
CPC ..... *G08B 13/1654* (2013.01); *G08B 13/06* (2013.01); *G08B 29/188* (2013.01)

(58) Field of Classification Search
CPC .. G08B 13/06; G08B 13/1654; G08B 29/183; G08B 21/0225; G08B 21/0233;
(Continued)

(56) References Cited

U.S. PATENT DOCUMENTS 9,613,524 B1 * 4/2017 Lamb ..... G08B 5/36
2004/0012502 A1 1/2004 Rasmussen
(Continued)

FOREIGN PATENT DOCUMENTS

CN 101023232 8/2007
CN 105336072 2/2016
(Continued)

OTHER PUBLICATIONS

Extended Search Report for European Patent Application No. 18152802.7, dated Jul. 16, 2018, 8 pages.
(Continued)

*Primary Examiner* — Mirza F Alam
(74) *Attorney, Agent, or Firm* — Sheridan Ross P.C.

(57) ABSTRACT

It is provided a method for determining when a break-in attempt is in process. The method is performed in a break-in determiner and comprises the steps of: determining that a first vibration condition is tme when a vibration parameter associated with a barrier is greater than a first threshold, wherein the first vibration parameter is obtained from measurements from an accelerometer; determining whether an acceptable activity condition is tme or not, such that the acceptable activity condition is true only when there is an auxiliary signal indicating acceptable activity comprising determining that the acceptable activity condition is tme only when a time difference between determining that the first vibration condition is true and receiving the auxiliary signal is less than a threshold duration; and determining that a break-in attempt is in process when the first vibration condition is tme and the acceptable activity condition is false.

19 Claims, 3 Drawing Sheets

(58) Field of Classification Search
CPC ..... G08B 13/04; G08B 25/008; E05B 45/005; E05B 45/06
See application file for complete search history.

(56) References Cited

U.S. PATENT DOCUMENTS

| | | | | |
|---|---|---|---|---|
| 2013/0057405 | A1* | 3/2013 | Seelman | G08B 13/08 340/545.2 |
| 2016/0117918 | A1* | 4/2016 | Schindler | G08B 29/188 340/545.2 |
| 2016/0187368 | A1* | 6/2016 | Modi | G01P 15/00 702/141 |
| 2018/0346047 | A1* | 12/2018 | Pankratius | B62H 5/20 |

FOREIGN PATENT DOCUMENTS

| | | |
|---|---|---|
| CN | 106504452 | 3/2017 |
| CN | 107023224 | 8/2017 |
| GB | 2528703 | 2/2016 |

OTHER PUBLICATIONS

International Search Report and Written Opinion for International (PCT) Patent Application No. PCT/EP2018/085632, dated Mar. 25, 2019, 14 pages.
Official Action with English Translation for China Patent Application No. 201880087066.5, dated Jun. 17, 2021, 22 pages.

* cited by examiner

DETERMINING WHEN A BREAK-IN ATTEMPT IS IN PROCESS

CROSS REFERENCE TO RELATED APPLICATIONS

This application is a national stage application under 35 U.S.C. 371 and claims the benefit of PCT Application No. PCT/EP2018/085632 having an international filing date of Dec. 18, 2018, which designated the United States, which PCT application claimed the benefit of Europe Patent Application No. 18152802.7 filed Jan. 22, 2018, the disclosure of each of which are incorporated herein by reference.

TECHNICAL FIELD

The invention relates to a method, break-in determiner, computer program and computer program product for determining when a break-in attempt is in process.

BACKGROUND

It is a continuous problem with break-ins in homes and commercial properties. There are a number of sensors in the prior art to detect such break-ins. Some sensor detect when a window or door is opened or glass is broken and other sensors detect movement.

One type of such sensor is based on accelerometers. These are used for detecting vibrations that occur when a break-in attempt occurs. In this way, an alarm can be raised prior to major structural damage occurring. Some of these solutions claim to be able to differentiate between a ball bounce or knock on a door and an attempted break-in.

However, it is very difficult to find the balance between an acceptable activity and a break-in. False alarms are very stressful and result in undermined trust of the alarm system. On the other hand, a missed detection of a break-in is even worse, since the whole point of such a sensor is to detect break-ins.

Additionally, many break-ins occur when residents are home. It would be of great benefit if there would be a possibility to be able to detect break-ins even if one or more windows or doors are open, e.g. if a person is home and a garden door is open, a break-in attempt through the front door should be detectable. Motion sensors are unusable when people are home.

US 2016/117918 A1 discloses an intrusion sensor for monitoring an entrance to a building to be monitored, and corresponding method. GB 2 528 703 A discloses a detection system and method for initiating an alarm condition. US 2004/012502 A1 discloses an alarm chip and use of the alarm chip. U.S. Pat. No. 9,613,524 B1 discloses a reduced false alarm security system.

SUMMARY

It is an object to improve the chance of detecting real break-in attempts while reducing the risk of false detections of break-in attempts.

According to a first aspect, it is provided a method for determining when a break-in attempt is in process. The method is performed in a break-in determiner and comprises the steps of: determining that a first vibration condition is true when a vibration parameter associated with a barrier is greater than a first threshold, wherein the first vibration parameter is obtained from measurements from an accelerometer; determining whether an acceptable activity condition is true or not, such that the acceptable activity condition is true only when there is an auxiliary signal indicating acceptable activity, comprising determining that the acceptable activity condition is true only when a time difference between determining that the first vibration condition is true and receiving the auxiliary signal is less than a threshold duration; and determining that a break-in attempt is in process when the first vibration condition is true and the acceptable activity condition is false.

The method may further comprise the step of: energising previously inactivated components of the break-in determiner when the first vibration condition is true.

The method may further comprise the step, prior to the step of determining that a first vibration condition is true, of: determining that an indicative vibration condition is true when a vibration parameter associated with the barrier is greater than an indicative threshold using measurements from an accelerometer; and wherein the steps of determining that a first vibration condition is true and determining whether the acceptable activity condition is true or not are only performed when the indicative vibration condition is true.

The step of determining whether the acceptable activity condition is true or not may comprise determining that the acceptable activity condition is true when the auxiliary signal is a lock action signal received from an electronic lock associated with the barrier, the lock action signal indicating that a valid locking or unlocking action is occurring.

The step of determining whether the acceptable activity condition is true or not may comprise determining that the acceptable activity condition is true when the auxiliary signal is a bolt action signal received from a bolt sensor associated with the barrier, the bolt action signal indicating that a bolt associated with a lock of the barrier is moving.

The step of determining whether a second condition is true or not may comprise determining that the acceptable activity condition is true when a sensor signal is received from a touch sensor of a handle on the inside of the barrier, the sensor signal indicating that a person touches the handle.

The method may further comprise the step of: determining that a vibration match condition is true when vibrations associated with the barrier match a predetermined pattern. In such a case, the step of determining comprises determining that a break-in attempt is in process when the first vibration condition is true, the second condition is false and the vibration match condition is true.

According to a second aspect, it is provided a break-in determiner for determining when a break-in attempt is in process. The break-in determiner comprises: a processor; and a memory storing instructions that, when executed by the processor, cause the break-in determiner to: determine that a first vibration condition is true when a vibration parameter associated with a barrier is greater than a first threshold, wherein the first vibration parameter is obtained from measurements from an accelerometer; determine whether an acceptable activity condition is true or not, such that the acceptable activity condition is true only when there is an auxiliary signal indicating acceptable activity comprising to determine that the acceptable activity condition is true only when a time difference between determining that the first vibration condition is true and receiving the auxiliary signal is less than a threshold duration; and determine that a break-in attempt is in process when the first vibration condition is true and the acceptable activity condition is false.

The break-in determiner may further comprise instructions that, when executed by the processor, cause the break-in determiner to energise previously inactivated components of the break-in determiner when the first vibration condition is true.

The break-in determiner may further comprise instructions that, when executed by the processor, cause the break-in determiner prior to the instructions to determine that a first vibration condition is true, to: determine that an indicative vibration condition is true when a vibration parameter associated with the barrier is greater than an indicative threshold using measurements from an accelerometer. In such a case, the instructions to determine that a first vibration condition is true and determine whether the acceptable activity condition is true or not, are only executed when the indicative vibration condition is true.

The break-in determiner may further comprise instructions that, when executed by the processor, cause the break-in determiner to determine that the acceptable activity condition is true when the auxiliary signal is a lock action signal received from an electronic lock associated with the barrier, the lock action signal indicating that a valid locking or unlocking action is occurring.

The break-in determiner may further comprise instructions that, when executed by the processor, cause the break-in determiner to determine that the acceptable activity condition is true when the auxiliary signal is a bolt action signal received from a bolt sensor associated with the barrier, the bolt action signal indicating that a bolt associated with a lock of the barrier is moving.

According to a third aspect, it is provided a computer program for determining when a break-in attempt is in process. The computer program comprises computer program code which, when run on a break-in determiner causes the break-in determiner to: determine that a first vibration condition is true when a vibration parameter associated with a barrier is greater than a first threshold, wherein the first vibration parameter is obtained from measurements from an accelerometer; determine whether an acceptable activity condition is true or not, such that the acceptable activity condition is true only when there is an auxiliary signal indicating acceptable activity comprising to determine that the acceptable activity condition is true only when a time difference between determining that the first vibration condition is true and receiving the auxiliary signal is less than a threshold duration; and determine that a break-in attempt is in process when the first vibration condition is true and the acceptable activity condition is false.

According to a fourth aspect, it is provided a computer program product comprising a computer program according to the third aspect and a computer readable means on which the computer program is stored.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Embodiments presented herein are based on the realisation that, in addition to using an accelerometer to determine when a break-in is in process, an auxiliary signal is utilised to determine whether an occurring vibration is to be determined to be acceptable.

Figure 1:
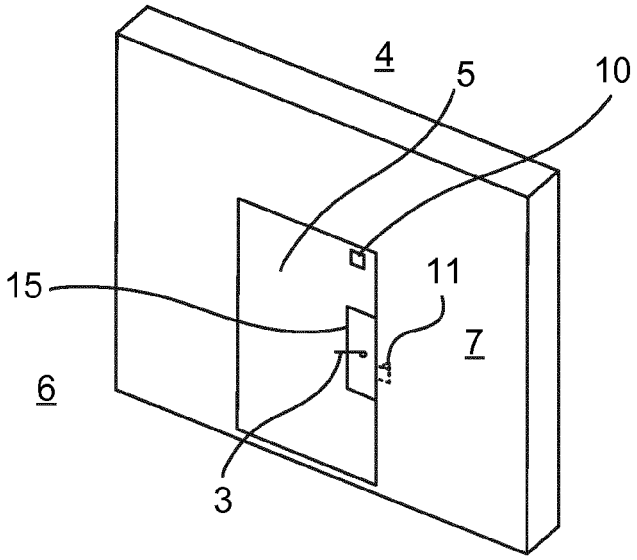
FIG. 1 is a schematic diagram showing an environment in which embodiments presented herein can be applied.

FIG. 1 is a schematic diagram showing an environment in which embodiments presented herein can be applied. Access to a physical space 6 is restricted by a physical barrier 5 which is selectively controlled to be in a locked state or an unlocked state. The physical barrier 5 can be a door, window, gate, hatch, cabinet door, drawer, etc. The physical barrier 5 is provided in a surrounding physical structure 7 (being a wall, fence, ceiling, floor, etc.) and is provided between the restricted physical space 6 and an accessible physical space 4. It is to be noted that the accessible physical space 4 can be a restricted physical space in itself, but in relation to this physical barrier 5, the accessible physical space 4 is accessible. A handle 3 is provided on the barrier to allow a person to open and close the barrier.

In order to unlock the barrier 5, a lock 15 is provided. The lock 15 can be a traditional mechanical lock or an electronic lock. It is to be noted that the lock 15 can be provided in the physical barrier 5 as shown or in the surrounding structure 7 (not shown).

An accelerometer 10 is provided to detect vibrations on or near the barrier 5. In this way, as explained in more detail below, a break-in attempt can be detected to allow further action. The accelerometer 10 can be a separate device as shown here, or the accelerometer can e.g. form part of the lock 15.

According to embodiments presented herein, at least one instance of an auxiliary signal, such as from an additional sensor, is used to determine whether there is an acceptable activity which explains the vibration detected by the accelerometer, in which case, an alarm should not be raised.

One example of such an additional sensor is a bolt sensor ii which can detect when a locking bolt is extended or retracted. The bolt movement is most likely the result of a legitimate user, which can thus be interpreted as an acceptable activity, reducing the risk of a false alarm. Alternatively or additionally, a latch sensor (see 14 of FIGS. 4A-B) can be provided to detect when a latch is extended or retracted. The latch is mechanically connected to handle movement. Also latch movement is most likely the result of a legitimate user, which can thus be interpreted as an acceptable activity, reducing the risk of a false alarm.

Figure 2:
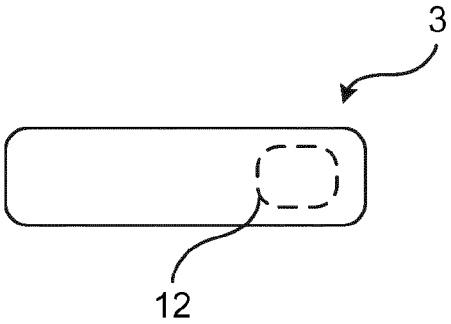
FIG. 2 is a schematic diagram illustrating a touch sensor on the handle of the barrier of FIG. 1.

FIG. 2 is a schematic diagram illustrating a touch sensor 12 on the handle 3 of the barrier of FIG. 1. The handle is in this case provided on the inside (i.e. in the restricted physical space 6 of FIG. 1) in relation to the barrier. The touch sensor 12 is another example of an additional sensor, which can detect an acceptable activity, where the acceptable activity is a user manoeuvring the handle 3 on the inside, which can result in vibrations.

Figure 3A:
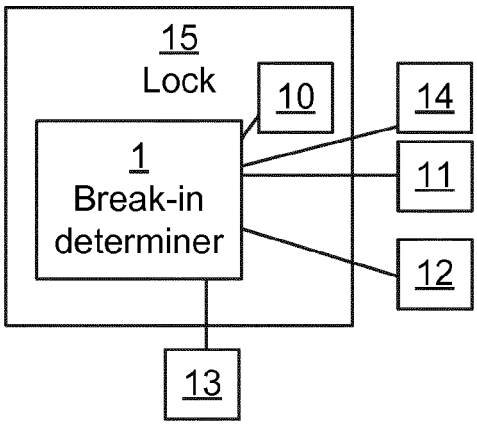
FIGS. 3A-B are schematic diagrams illustrating embodiments of where the break-in determiner 1 can be implemented.
Figure 3B:
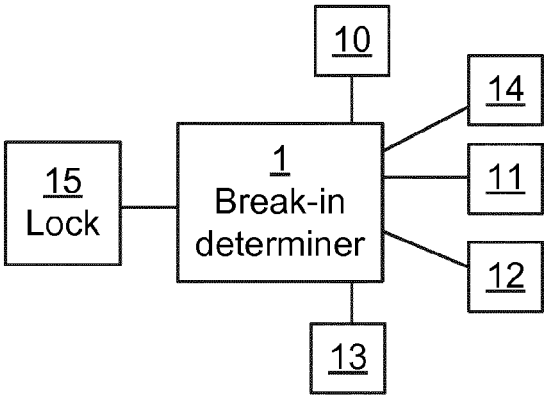

FIGS. 3A-B are schematic diagrams illustrating embodiments of where the break-in determiner 1 can be implemented.

In FIG. 3A, the break-in determiner 1 is shown as implemented in the lock 15. The lock 15 is thus the host device for the break-in determiner 1. In this embodiment, the lock 15 is an electronic lock. The break-in determiner 1 is also connected to an accelerometer 10 which here forms part of the lock 15, but the accelerometer could also be external to the lock 15. External to the lock 15, the break-in determiner 1 is connected to the bolt sensor ii, the latch sensor 14 and/or the touch sensor 12. A barrier sensor 13 is optionally provided which is capable of detecting the state of the barrier. In a simple version, the barrier sensor 13 can detect if the barrier is open or closed. In a more advanced version, the barrier sensor 13 can also detect a degree of opening. The barrier sensor 13 can e.g. be based on a magnetic sensor with a matching magnetic material, such that the magnetic sensor is mounted on the barrier and the magnetic material is mounted on the surrounding structure, or vice versa.

In FIG. 3B, the break-in determiner 1 is shown as implemented as a stand-alone device. In this embodiment, the break-in determiner 1 does not have a host device. Hence, the break-in determiner 1 is connected to an accelerometer 10 (which could alternatively form part of the break-in determiner 1) as well as the bolt sensor ii, the latch sensor 14 and/or the touch sensor 12. Furthermore, the break-in determiner can be connected to the lock 15. The connection between the break-in determiner and the external devices 10, 11, 12, 15 could be wireless based, e.g. based on BLE or any other of the possible wireless protocols supported by the break-in determiner as mentioned below.

Optionally, the accelerometer if formed in one unit with the bolt sensor 11, the latch sensor 14 and/or the touch sensor 12. This greatly simplifies communication between different functions when battery powered components are used, since there is no complicated transmission schedule/wake-up scheme between the accelerometer and a secondary sensor being the source of the auxiliary signal.

It is to be noted that the bolt sensor 11 and/or the latch sensor 14 can also form part of the lock 15.

Figure 4:
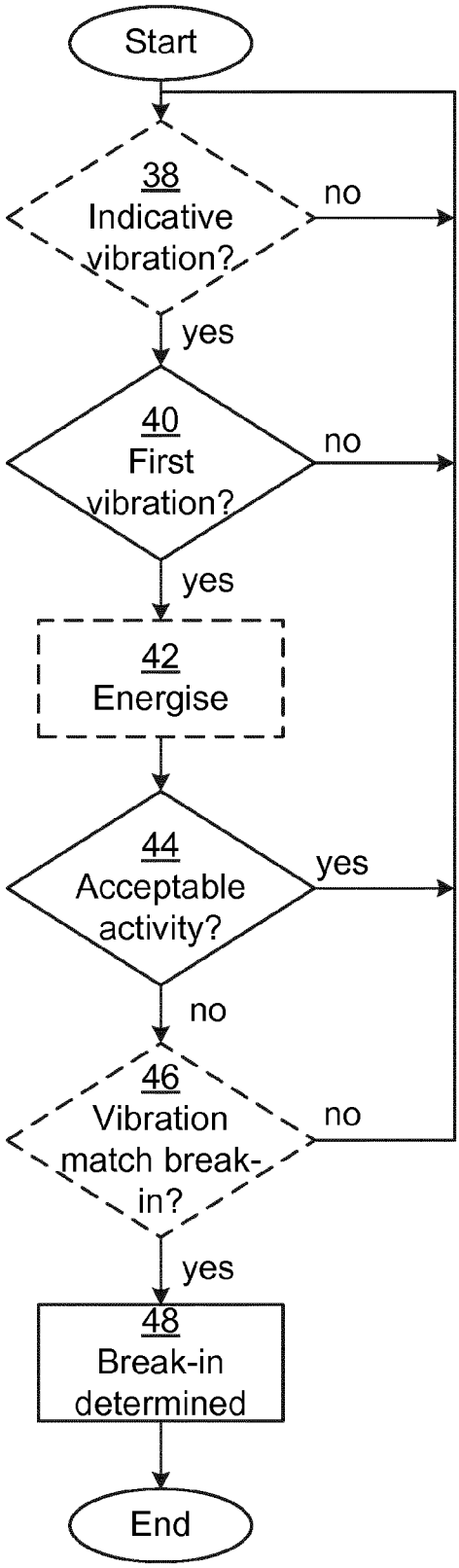
FIG. 4 is a flow chart illustrating embodiments of methods break-in determiner for determining when a break-in attempt is in process.
Figure 5:
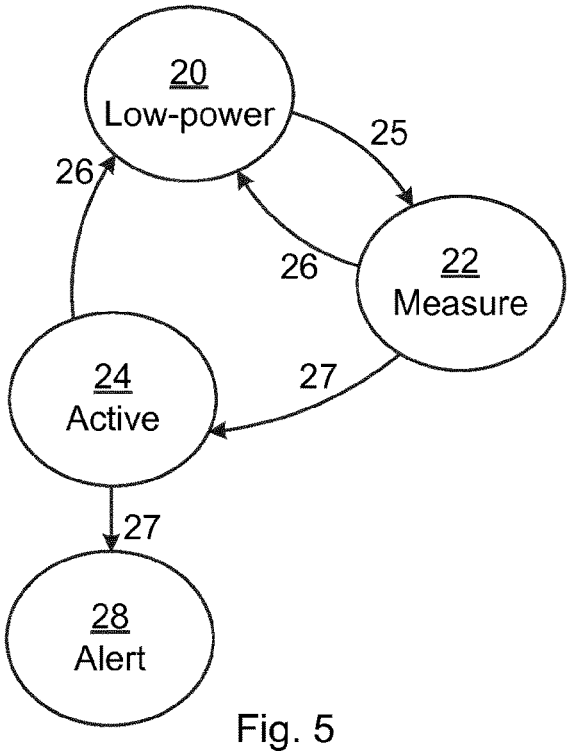
FIG. 5 is a state diagram illustrating various states of the break-in determiner.

FIG. 4 is a flow chart illustrating embodiments of methods performed in the break-in determiner for determining when a break-in attempt is in process and FIG. 5 is a state diagram illustrating various states of the break-in determiner. Functions of the break-in determiner will be described now with reference both to the flow chart of FIG. 4 and the state diagram of FIG. 5.

When the method starts, the break-in determiner 1 is in a low-power state 20. In this state, the processor (e.g. MCU) can be switched off and vibrations are sampled with low frequency to preserve power.

In an optional conditional indicative vibration step 38, the break-in determiner determines that an indicative vibration condition is true when a vibration parameter associated with the barrier is greater than an indicative threshold. This vibration parameter can e.g. be a strength of vibration or a length of vibration or a combination of both. The indicative threshold is obtained using measurements from an accelerometer, which is collected while in the low-power state 20. When the indicative vibration condition is true, this corresponds to a transition 25 in the state diagram to a measure state 22, and the method proceeds to a conditional first vibration step 40. Otherwise, the method repeats this step, optionally after an idle period to keep power consumption low.

In the conditional first vibration step 40, the break-in determiner determines that a first vibration condition is true when a vibration parameter associated with a barrier is greater than a first threshold. Again, the vibration parameter can e.g. be a strength of vibration or a length of vibration or a combination of both. The first vibration parameter is obtained from measurements from an accelerometer. In this step, the break-in determiner is in the measure state 22, in which the processor can still be off, but vibrations are sampled more often than in the low-power state 20.

When the first vibration condition is true, this corresponds to a transition 27 in the state diagram to an active state 24, and the method proceeds to an optional energise step 42, or to a conditional acceptable activity step 44 when the optional energise step 42 is not performed. Otherwise, the method returns to the start of the method, corresponding to a transition 26 from the measure state 22 to the low-power state 20.

In the optional energise step 42, the break-in determiner energises previously inactivated components of the break-in determiner. This is performed when the break-in determines assumes the active state 24, powering up the processor and potentially other components of the break-in determiner.

In the conditional acceptable activity step 44, the break-in determiner determines whether an acceptable activity condition is true or not. The acceptable activity condition is true only when there is an auxiliary signal indicating acceptable activity. The auxiliary signal can be based on a second source or the auxiliary signal can be based on the accelerometer. When the auxiliary signal is based on the accelerometer, e.g. when the accelerometer is mounted on a handle, the auxiliary signal can indicate normal rotational movement of the handle by integrating or double integrating the acceleration. Such handle movement is then considered an acceptable activity.

For instance, the acceptable activity condition can be true when the auxiliary signal is a lock action signal received from an electronic lock associated with the barrier, wherein the lock action signal indicates that a valid locking or unlocking action is occurring. The second source is in this case the electronic lock. Alternatively or additionally, the acceptable activity condition can be true when the electronic lock is in an unlocked state. In such a state, it is acceptable to open the barrier from the outside.

Alternatively or additionally, the acceptable activity condition is true when the auxiliary signal is a bolt action signal received from a bolt sensor associated with the barrier, wherein the bolt action signal indicates that a bolt associated with a lock of the barrier is moving. The second source is in this case the bolt sensor.

Alternatively or additionally, the acceptable activity condition is true when the auxiliary signal is a latch action signal received from a latch sensor associated with the barrier, wherein the latch action signal indicates that a latch associated with a lock of the barrier is moving. The second source is in this case the latch sensor.

Alternatively or additionally, the acceptable activity condition is true when the auxiliary signal is a sensor signal received from a touch sensor of a handle on the inside of the barrier, wherein the sensor signal indicates that a person touches the handle or has a body part in the vicinity of the handle. The second source is in this case the touch sensor. The touch sensor can be an inductive touch sensor or a capacitive touch sensor.

The acceptable activity condition is determined to be true by also considering a time difference between determining that the first vibration condition is true and receiving the auxiliary signal indicating acceptable activity. The acceptable activity condition is true only when the time difference is less than a threshold duration. For instance, when applied with the bolt sensor, an attacker might eventually manage to move the bolt after breaking a door open. However, compared to the bolt causing the vibrations (an acceptable case), the bolt movement after a break-in will be significantly later in time than the detected vibrations.

Alternatively or additionally, the acceptable activity condition is true when the auxiliary signal is a barrier sensor signal is received from a barrier sensor. The barrier sensor is able to detect when the barrier is open or closed and/or when the barrier transitions between the open state and closed state. When the barrier sensor signal indicates that the barrier is opened within the threshold time from detecting the first vibration, the acceptable activity condition is true. Optionally, the acceptable activity condition is true only when the barrier sensor signal indicates that the barrier is open more than a threshold amount, since an attacker can cause the barrier to open slightly (e.g. when applying a crowbar to the barrier) during a break-in attempt.

When the acceptable activity condition is false, the method proceeds to an optional conditional vibration match break-in step 46 or a break-in determined step 48. Otherwise, the method returns to the start of the method, corresponding to a transition 28 to the low-power state 20. In such a transition, some components, such as the processor, of the break-in determiner are switched off to save power. It is to be noted that also from the measure state 22, the break-in determiner can assume the low-power state 20 when the acceptable activity condition is true or when vibrations are sufficiently short in duration. Additionally, from the active state 24, the break-in determiner can transition 26 to the low-power state 20 when the vibrations stop.

In the optional conditional vibration match break-in step 46, the break-in determiner determines that a vibration match condition is true when vibrations associated with the barrier match a predetermined pattern. This matching can e.g. be based on spectrum analysis or artificial intelligence (AI). Additionally or alternatively, the vibration is determined to match the break-in when the vibrations occur for a duration longer than a duration threshold. Optionally, the matching is also dependent on a state transition loop. The state transition loop is the loop from the low-power state 20, to the measure state 22, to the active state 24 and back to the low-power state 20. For instance, the matching may depend on how long the loop duration is, how often the loop occurs, etc.

When the vibration match condition is true, the method proceeds to a break-in determined step. Otherwise, the method returns to the start of the method.

In the break-in determined step 48, the break-in determiner has passed through a number of conditions indicating that a break-in is determined. This can result in communication with a communication gateway or alarm component to sound an alarm or alert a central alarm service centre or the police. In this step, the break-in determiner has assumed an alert state 28. The transition 27 to this state is from the active state 24.

Optionally, the indicative threshold and the first threshold are reconfigured by the break-in determiner when in the active state 24 to match acceptable usage in this particular installation. Optionally, the indicative threshold and the first threshold are determined in a training phase after the break-in determiner is installed to tailor these thresholds to vibration propagations in the particular installation and to vibrations occurring in the installation based on acceptable activities by users of the installation, e.g. doors closing, indoor sports activities, playing, etc.

By employing the acceptable activity conditions, the break-in determination of vibrations can be made more aggressive without resulting in too many false break-in determinations.

Moreover, embodiments presented herein can be utilised as an automated perimeter alarm. For instance, if a user opens a door or window from the inside (detected by the secondary sensor) or if the locking bolt is moved when unlocking a door from the outside, the concurrent vibration is determined to be acceptable. On the other hand, if a similar vibration is detected without an acceptable user manipulation, this will trigger an alarm.

An example scenario for a window opening, when the secondary sensor can detect the bolt state, could then be as follows:

1. The handle on the inside starts to be manipulated towards an open state.

2. The accelerometer detects the vibrations and causes a transition to the measure state 22 and then to the active state 24.

3. In the active state 24, the break-in determiner uses a bolt sensor to detect any bolt movement. If the bolt moves, the activity is acceptable and the low-power state 20 is assumed. In case of a break-in, the bolt will not move (at least not initially), whereby the alert state 28 is assumed.

When a barrier, such as a window or door, can be put in an airing position, some special consideration can be applied. A third sensor can be used to detect if the barrier is in an airing position and optionally if the barrier is in a locked airing position or in an unlocked airing position. When the barrier is in a locked airing position, the same break-in detection as is described above can be applied. Also when the barrier is in an unlocked, but fixed, airing position, the same break-in detection can be applied.

Figure 6:
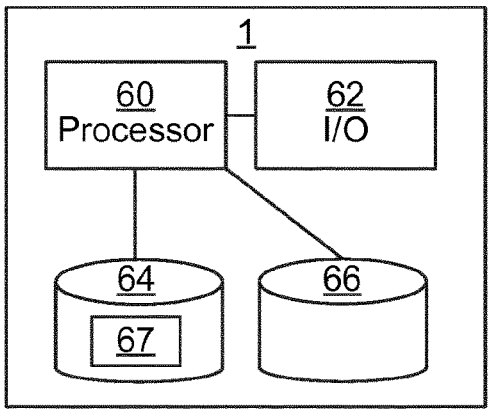
FIG. 6 is a schematic diagram illustrating components of the break-in determiner of FIGS. 3A-B.

FIG. 6 is a schematic diagram illustrating components of the break-in determiner 1 of FIGS. 3A-B. It is to be noted that one or more of the mentioned components can be shared with the host device, when present. A processor 60 is provided using any combination of one or more of a suitable microcontroller unit (MCU), central processing unit (CPU), multiprocessor, digital signal processor (DSP), etc., capable of executing software instructions 67 stored in a memory 64, which can thus be a computer program product. The processor 60 could alternatively be implemented using an application specific integrated circuit (ASIC), field programmable gate array (FPGA), etc. The processor 60 can be configured to execute the method described with reference to FIG. 4 above.

The memory 64 can be any combination of random access memory (RAM) and/or read only memory (ROM). The memory 64 also comprises persistent storage, which, for example, can be any single one or combination of solid-state memory, magnetic memory and optical memory.

A data memory 66 is also provided for reading and/or storing data during execution of software instructions in the processor 60. The data memory 66 can be any combination of RAM and/or ROM.

The break-in determiner 1 further comprises an I/O interface 62 for communicating with external entities, e.g. via a wireless interface such as Bluetooth or Bluetooth Low Energy (BLE), ZigBee, any of the IEEE 802.11x standards (also known as WiFi), etc.

Other components of the break-in determiner 1 are omitted in order not to obscure the concepts presented herein.

Figure 7:
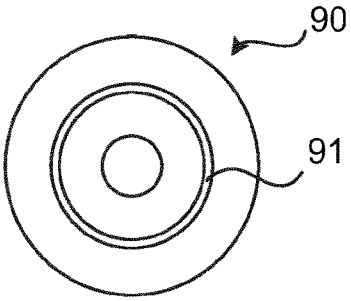
FIG. 7 shows one example of a computer program product 90 comprising computer readable means.

FIG. 7 shows one example of a computer program product 90 comprising computer readable means. On this computer readable means, a computer program 91 can be stored, which computer program can cause a processor to execute a method according to embodiments described herein. In this example, the computer program product is an optical disc, such as a CD (compact disc) or a DVD (digital versatile disc) or a Blu-Ray disc. As explained above, the computer program product could also be embodied in a memory of a device, such as the computer program product 64 of FIG. 6. While the computer program 91 is here schematically shown as a track on the depicted optical disk, the computer program can be stored in any way which is suitable for the computer program product, such as a removable solid state memory, e.g. a Universal Serial Bus (USB) drive.

Here now follows a list of embodiments from another perspective, enumerated with roman numerals.

i. A method for determining when a break-in attempt is in process, the method being performed in a break-in determiner and comprising the steps of:

determining that a first vibration condition is true when a vibration parameter associated with a barrier is greater than a first threshold, wherein the first vibration parameter is obtained from measurements from an accelerometer;

determining whether an acceptable activity condition is true or not, such that the acceptable activity condition is true only when there is a second signal (the auxiliary signal mentioned above) indicating acceptable activity; and determining that a break-in attempt is in process when the first vibration condition is true and the acceptable activity condition is false.

ii. The method according to embodiment i, wherein the step of determining whether an acceptable activity condition is true or not comprises determining that the acceptable activity condition is true only when a time difference between determining that the first vibration condition is true and receiving the second signal is less than a threshold duration.

iii. The method according to embodiment i or ii, further comprising the step of:

energising previously inactivated components of the break-in determiner when the first vibration condition is true.

iv. The method according to embodiment iii, further comprising the step, prior to the step of determining that a first vibration condition is true, of:

determining that an indicative vibration condition is true when a vibration parameter associated with the barrier is greater than an indicative threshold using measurements from an accelerometer; and wherein the steps of determining that a first vibration condition is true and determining whether the acceptable activity condition is true or not are only performed when the indicative vibration condition is true.

v. The method according to any one of the preceding embodiments, wherein the step of determining whether the acceptable activity condition is true or not comprises determining that the acceptable activity condition is true when the second signal is a lock action signal received from an electronic lock associated with the barrier, the lock action signal indicating that a valid locking or unlocking action is occurring.

vi. The method according to any one of the preceding embodiments, wherein the step of determining whether the acceptable activity condition is true or not comprises determining that the acceptable activity condition is true when the second signal is a bolt action signal received from a bolt sensor associated with the barrier, the bolt action signal indicating that a bolt associated with a lock of the barrier is moving.

vii. The method according to any one of the preceding embodiments, wherein the step of determining whether a second condition is true or not comprises determining that the acceptable activity condition is true when a sensor signal is received from a touch sensor of a handle on the inside of the barrier, the sensor signal indicating that a person touches the handle.

viii. The method according to any one of the preceding embodiments, further comprising the step of:

determining that a vibration match condition is true when vibrations associated with the barrier match a predetermined pattern; and wherein the step of determining comprises determining that a break-in attempt is in process when the first vibration condition is true, the second condition is false and the vibration match condition is true.

ix. A break-in determiner for determining when a break-in attempt is in process, the break-in determiner comprising:

a processor; and a memory storing instructions that, when executed by the processor, cause the break-in determiner to:

determine that a first vibration condition is true when a vibration parameter associated with a barrier is greater than a first threshold, wherein the first vibration parameter is obtained from measurements from an accelerometer;

determine whether an acceptable activity condition is true or not, such that the acceptable activity condition is true only when there is a second signal indicating acceptable activity; and determine that a break-in attempt is in process when the first vibration condition is true and the acceptable activity condition is false.

x. The break-in determiner according to embodiment ix, further comprising instructions that, when executed by the processor, cause the break-in determiner to energise previously inactivated components of the break-in determiner when the first vibration condition is true.

xi. The break-in determiner according to embodiment x, further comprising instructions that, when executed by the processor, cause the break-in determiner prior to the instructions to determine that a first vibration condition is true, to:

determine that an indicative vibration condition is true when a vibration parameter associated with the barrier is greater than an indicative threshold using measurements from an accelerometer; and wherein the instructions to determine that a first vibration condition is true and determine whether the acceptable activity condition is true or not, are only executed when the indicative vibration condition is true.

xii. The break-in determiner of any one of embodiments ix to xi, further comprising instructions that, when executed by the processor, cause the break-in determiner to determine that the acceptable activity condition is true when the second signal is a lock action signal received from an electronic lock associated with the barrier, the lock action signal indicating that a valid locking or unlocking action is occurring.

xiii. The break-in determiner of any one of embodiments ix to xii, further comprising instructions that, when executed by the processor, cause the break-in determiner to determine that the acceptable activity condition is true when the second signal is a bolt action signal received from a bolt sensor associated with the barrier, the bolt action signal indicating that a bolt associated with a lock of the barrier is moving.

xiv. A computer program for determining when a break-in attempt is in process, the computer program comprising computer program code which, when run on a break-in determiner causes the break-in determiner to:

determine that a first vibration condition is true when a vibration parameter associated with a barrier is greater than a first threshold, wherein the first vibration parameter is obtained from measurements from an accelerometer;

determine whether an acceptable activity condition is true or not, such that the acceptable activity condition is true only when there is a second signal indicating acceptable activity; and determine that a break-in attempt is in process when the first vibration condition is true and the acceptable activity condition is false.

xv. A computer program product comprising a computer program according to embodiment xiv and a computer readable means on which the computer program is stored.

The invention has mainly been described above with reference to a few embodiments. However, as is readily appreciated by a person skilled in the art, other embodiments than the ones disclosed above are equally possible within the scope of the invention, as defined by the appended patent claims.

What is claimed is:

1. A method for determining when a break-in attempt is in process, the method being performed in a break-in determiner and comprising:

determining that a first vibration condition is true when a vibration parameter associated with a barrier is greater than a first threshold, wherein the first vibration parameter is obtained from measurements from an accelerometer;

energizing previously inactivated components of the break-in determiner when the first vibration condition is true;

determining, after the energizing, whether an acceptable activity condition is true or not, such that the acceptable activity condition is true only when there is an auxiliary signal indicating acceptable activity, comprising determining that the acceptable activity condition is true only when a time difference between determining that the first vibration condition is true and receiving the auxiliary signal is less than a threshold duration;

determining that a break-in attempt is in process when the first vibration condition is true and the acceptable activity condition is false.

2. The method according to claim 1, further comprising, prior to the determining that a first vibration condition is true:

determining that an indicative vibration condition is true when a vibration parameter associated with the barrier is greater than an indicative threshold using measurements from an accelerometer, wherein the determining that a first vibration condition is true and the determining whether the acceptable activity condition is true or not are only performed when the indicative vibration condition is true.

3. The method according to claim 1, wherein determining whether the acceptable activity condition is true or not comprises determining that the acceptable activity condition is true when the auxiliary signal is a lock action signal received from an electronic lock associated with the barrier, the lock action signal indicating that a valid locking or unlocking action is occurring.

4. The method according to claim 1, wherein determining whether the acceptable activity condition is true or not comprises determining that the acceptable activity condition is true when the auxiliary signal is a bolt action signal received from a bolt sensor associated with the barrier, the bolt action signal indicating that a bolt associated with a lock of the barrier is moving.

5. The method according to claim 1, wherein determining whether a second condition is true or not comprises determining that the acceptable activity condition is true when a sensor signal is received from a touch sensor of a handle on the inside of the barrier, the sensor signal indicating that a person touches the handle.

6. The method according to claim 1, further comprising:

determining that a vibration match condition is true when vibrations associated with the barrier match a predetermined pattern; and wherein determining comprises determining that a break-in attempt is in process when the first vibration condition is true, the second condition is false and the vibration match condition is true.

7. A break-in determiner for determining when a break-in attempt is in process, the break-in determiner comprising:

a processor; and a memory storing instructions that, when executed by the processor, cause the break-in determiner to:

determine that a first vibration condition is true when a vibration parameter associated with a barrier is greater than a first threshold, wherein the first vibration parameter is obtained from measurements from an accelerometer;

energize previously inactivated components of the break-in determiner when the first vibration condition is true;

determine, after the energizing, whether an acceptable activity condition is true or not, such that the acceptable activity condition is true only when there is an auxiliary signal indicating acceptable activity comprising to determine that the acceptable activity condition is true only when a time difference between determining that the first vibration condition is true and receiving the auxiliary signal is less than a threshold duration;

determine that a break-in attempt is in process when the first vibration condition is true and the acceptable activity condition is false.

8. The break-in determiner according to claim 7, further comprising instructions that, when executed by the processor, cause the break-in determiner prior to the instructions to determine that a first vibration condition is true, to:

determine that an indicative vibration condition is true when a vibration parameter associated with the barrier is greater than an indicative threshold using measurements from an accelerometer; and wherein the instructions to determine that a first vibration condition is true and determine whether the acceptable activity condition is true or not, are only executed when the indicative vibration condition is true.

9. The break-in determiner of claim 7, further comprising instructions that, when executed by the processor, cause the break-in determiner to determine that the acceptable activity condition is true when the auxiliary signal is a lock action signal received from an electronic lock associated with the barrier, the lock action signal indicating that a valid locking or unlocking action is occurring.

10. The break-in determiner of claim 7, further comprising instructions that, when executed by the processor, cause the break-in determiner to determine that the acceptable activity condition is true when the auxiliary signal is a bolt action signal received from a bolt sensor associated with the barrier, the bolt action signal indicating that a bolt associated with a lock of the barrier is moving.

11. A non-transitory computer-readable medium comprising a computer program for determining when a break-in attempt is in process, the computer program comprising computer program code which, when run on a break-in determiner causes the break-in determiner to:

determine that a first vibration condition is true when a vibration parameter associated with a barrier is greater than a first threshold, wherein the first vibration parameter is obtained from measurements from an accelerometer;

energize previously inactivated components of the break-in determiner when the first vibration condition is true;

determine, after the previously inactivated components of the break-in determiner have been energized, whether an acceptable activity condition is true or not, such that the acceptable activity condition is true only when there is an auxiliary signal indicating acceptable activity, comprising to determine that the acceptable activity condition is true only when a time difference between determining that the first vibration condition is true and receiving the auxiliary signal is less than a threshold duration;

determine that a break-in attempt is in process when the first vibration condition is true and the acceptable activity condition is false; and cause the break-in determiner to energize previously inactivated components of the break-in determiner when the first vibration condition is true.

12. The method according to claim 1, wherein at least one of the previously inactivated components of the break-in determiner are used to determine, after the energizing, whether the acceptable activity condition is true or not.

13. The break-in determiner according to claim 7, wherein at least one of the previously inactivated components of the break-in determiner are used to determine, after the energizing, whether the acceptable activity condition is true or not.

14. The non-transitory computer-readable medium according to claim 11, wherein at least one of the previously inactivated components of the break-in determiner are used to determine, after the energizing, whether the acceptable activity condition is true or not.

15. The method according to claim 1, wherein at least one of the previously inactivated components of the break-in determiner comprises a processor.

16. The method according to claim 15, wherein energizing comprises powering up the processor.

17. The break-in determiner according to claim 7, wherein at least one of the previously inactivated components of the break-in determiner comprises a processor.

18. The break-in determiner according to claim 17, wherein the processor is powered up as part of being energized.

19. The non-transitory computer-readable medium according to claim 11, wherein at least one of the previously inactivated components of the break-in determiner comprises a processor.

* * * * *